US008442252B2

(12) United States Patent
Meosky et al.

(10) Patent No.: US 8,442,252 B2
(45) Date of Patent: May 14, 2013

(54) BEHIND-THE-EAR HEARING AID WITH INTERCHANGEABLE EAR HOOK AND EAR TUBE

(75) Inventors: Stephen Meosky, Austin, TX (US); Frederick Neumeyer, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 279 days.

(21) Appl. No.: 12/895,212

(22) Filed: Sep. 30, 2010

(65) Prior Publication Data

US 2012/0082331 A1 Apr. 5, 2012

(51) Int. Cl.
*H04R 25/00* (2006.01)

(52) U.S. Cl.
USPC ..... 381/324; 381/322; 381/323; 381/328; 381/330

(58) Field of Classification Search ..... 381/312, 381/322, 324, 330, 380–382
See application file for complete search history.

(56) References Cited

U.S. PATENT DOCUMENTS 4,291,203 A * 9/1981 Bellafiore ..... 381/328
5,204,917 A 4/1993 Arndt et al.
6,233,344 B1 5/2001 Clegg et al.
6,496,587 B1 12/2002 Mueller
6,748,094 B1 * 6/2004 Tziviskos et al. ..... 381/330
7,151,839 B2 12/2006 Niederdrank
7,522,743 B2 4/2009 Dobras et al.
7,555,356 B2 6/2009 Roth et al.
7,602,933 B2 10/2009 Cartwright et al.
7,684,579 B2 3/2010 Ochsenbein et al.
7,715,572 B2 5/2010 Solomito, Jr. et al.
7,715,580 B2 5/2010 Nielsen
7,720,245 B2 5/2010 Bauman et al.
7,735,996 B2 6/2010 Van der Zwan et al.
2002/0041697 A1 4/2002 MacDonald et al.
2003/0112991 A1 6/2003 Rapps
2006/0171550 A1 8/2006 Bryant et al.
2007/0009130 A1 1/2007 Feeley et al.
2007/0064965 A1 3/2007 Feeley et al.
2007/0064966 A1 3/2007 Feeley et al.
2007/0064967 A1 3/2007 Feeley et al.
2008/0002849 A1 1/2008 Tan
2008/0025541 A1 1/2008 Watanuki
2008/0085024 A1 4/2008 Linkenkaer-Hansen et al.
2008/0205680 A1 8/2008 Ho et al.
2009/0134306 A1 5/2009 Koo
2009/0136070 A1 5/2009 Koo
2010/0086157 A1 * 4/2010 Feeley et al. ..... 381/324

* cited by examiner

*Primary Examiner* — Ahmad Matar
*Assistant Examiner* — Sabrina Diaz
(74) *Attorney, Agent, or Firm* — Lee & Hayes, PLLC

(57) ABSTRACT

A hearing aid includes a casing, an ear hook, and an ear tube. The casing includes a first connector on an upper portion of the casing and a second connector on a lower portion of the casing, wherein the first and second connectors are substantially identical. The ear hook includes a receptacle sized to fit the first and second connectors and adapted to releasably couple to one of the first connector and the second connector. The ear tube includes a receptacle sized to fit the first and second connectors and adapted to releasably couple to another of the first connector and the second connector.

21 Claims, 7 Drawing Sheets

BEHIND-THE-EAR HEARING AID WITH INTERCHANGEABLE EAR HOOK AND EAR TUBE

FIELD

This disclosure relates generally to hearing aids, and more particularly, to external hearing aids that are designed to be worn behind the ear.

BACKGROUND

Behind-the-ear hearing aids are very common because they are cheaper than in-the-ear designs and because they do not require customized fitting for the user. Conventional behind-the-ear hearing aid designs include a casing or housing that secures circuitry configured to modulate sounds to compensate for the user's hearing loss. Such hearing aid designs further include an ear tube that is coupled to such circuitry and that is flexible, extending over the top of the ear and resting on the pinna of the ear. Typically, the ear tube includes a wax guard at a distal end, which wax guard can be positioned in the ear canal to secure the hearing aid to the ear. Such a behind-the-ear hearing aid configuration applies downward pressure against the back of the ear via the casing and against the top or pinna of the ear via the ear tube, resisting gravitational forces.

The wax guard fits within an outer portion of the ear canal and is held in place by a circumferential pressure applied by the walls of the ear canal on the wax guard. This circumferential pressure holds the wax guard and the hearing aid in place and against the back of the user's ear.

While the tube and wax guard cooperate to secure the hearing aid sufficiently for normal actives, during strenuous physical activities, such as running, biking, or other sporting activities, the over-the-ear tube configuration applies insufficient pressure to maintain the position of the hearing aid. In some instances, abrupt movements by the user cause the hearing aid to shift, slide, bounce, or otherwise move, causing discomfort and/or ultimately dislodging the hearing aid from the user's ear.

In some instances, to provide additional support, the hearing aid includes a retaining wire configured to hook to the cymba conchae of the ear, providing a secondary securing means to augment that provided by the canal tube and the wax guard. While the retaining wire provides additional support, the hearing aid can still shift and become loose during strenuous physical activities. Further, such additional retention means can cause discomfort to the user.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Conventionally, a behind-the-ear hearing aid system secures the hearing aid based on the gravitational forces, friction of the ear canal tube resting on the user's ear, pressure of the wax guard against the ear canal, and optionally a retaining wire. However, the hearing aid can still become dislodged in response to rapid changes in forces on the hearing aid during strenuous physical activities for example. Accordingly, the hearing aid can move or shift causing physical discomfort to the user, introducing acoustic distortions due to changes in the position of an ear bud associated with the wax guard within the user's ear canal. In some cases, the user's movement during strenuous activates can even dislodge the hearing aid from the user's ear, which can damage the device.

Embodiments of a hearing aid described below are configurable to secure the hearing aid to the user's ear from more than one direction, such as both over and under the ear lobe, and in more than one configuration (an over-the-ear configuration or an under-the-ear configuration). As used herein, the terms "over-the-ear configuration" and "under-the-ear configuration" refer to the configuration of the ear tube relative to the ear of the user and the corresponding arrangement of the ear tube relative to connectors associated with the casing of the hearing aid.

In an example, the hearing aid includes a hook that extends over the top of the pinna of the outer ear where the pinna attaches to the user's head and an ear tube that extends under the ear lobe and into the ear canal, where it is secured by a wax guard. This is an example of an under-the-ear configuration. The ear hook and the body portion of the hearing aid secure the hearing aid behind-the-ear by resisting gravitational forces. The canal tube and the wax guard cooperate to secure the hearing aid from the other side of the ear (i.e. below the ear or under the ear lobe). Thus, the ear hook, the casing, and the ear tube cooperate to apply substantially opposing pressures to different sides of the ear. By securing the hearing aid both below and above the ear, the hook and the ear tube cooperate to secure the hearing aid from dislodging in response to rapid movements or abrupt changes in direction. One illustrative example of such a hearing aid of many possible configurations is described below with respect to FIG. 1.

Figure 1:
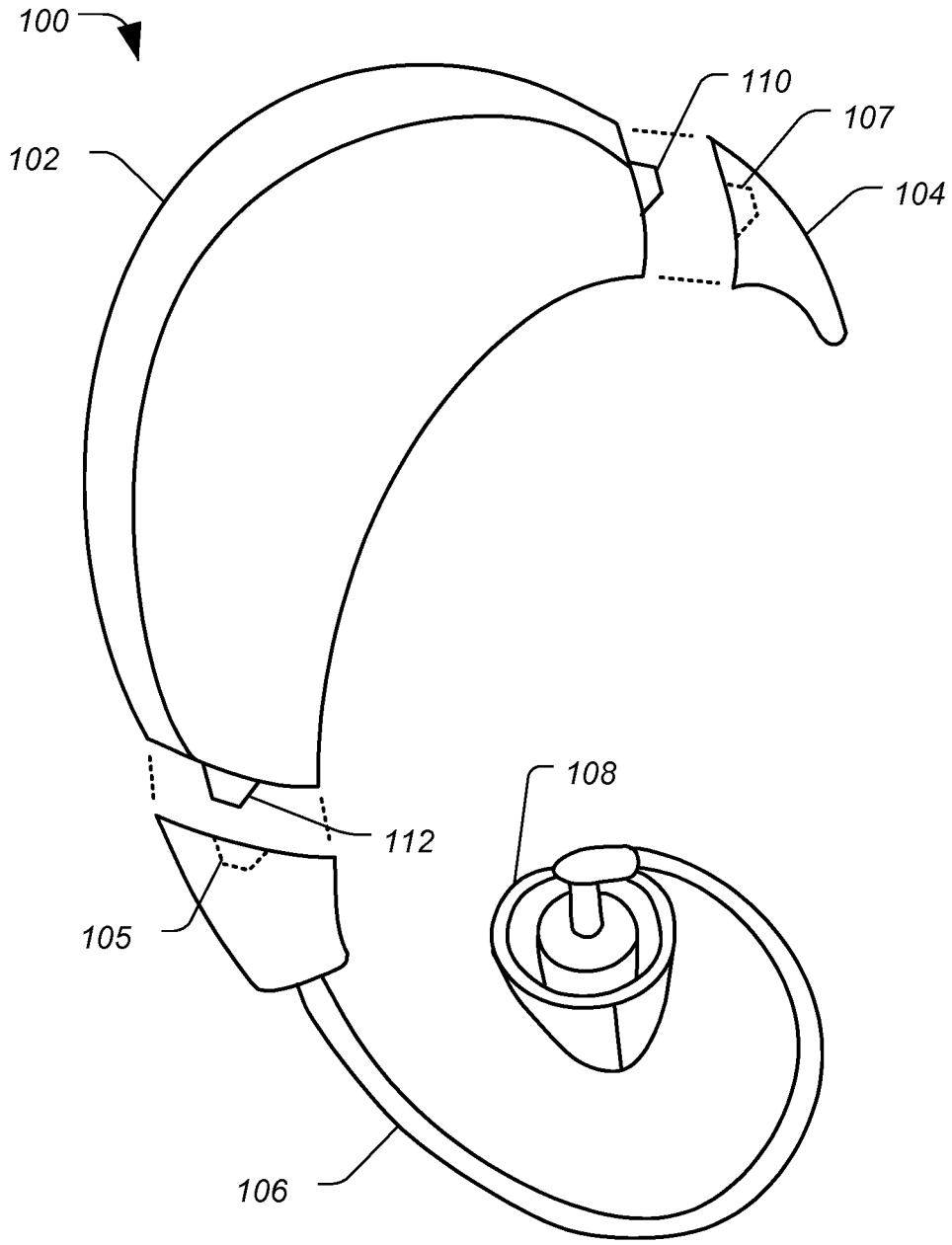
FIG. 1 is a perspective view of an embodiment of a hearing aid including an exploded view of an embodiment of an ear hook and under-the-ear configuration.

FIG. 1 is a perspective view of a hearing aid 100 including a casing 102 with an ear hook 104 and an ear tube 106. Casing 102 is molded, moldable, or otherwise designed to fit comfortably behind the ear of a user. Casing 102 defines an enclosure to secure sound processing circuitry, such as a digital signal processor, a microphone, a speaker, logic, a battery, and other circuitry. Casing 102 includes connectors 110 and 112, each of which includes at least one electrical contact or opening for communicating audio data to ear tube 106. Ear hook 104 includes a receptacle 107, which is adapted to releasably attach to connector 110 located on the upper portion of casing 102 to secure ear hook 104 to casing 102. Once attached, ear hook 104 extends from the upper portion of the casing 102 in a substantially hook shape, which is designed to fit over the top of the user's ear. In particular, the ear hook 104 is designed to fit between the pinna at the top of the user's ear and the user's head and to rest on the top portion of the ear where the outer ear attaches to the user's head. Ear hook 104 rests on the ear and partially counterbalances a weight of the casing 102, securing casing 102 behind the ear by resisting gravity.

Ear tube 106 includes a receptacle 105, a flexible (longitudinal) portion, and an end portion (distal end). Receptacle 105 couples to connector 112 at a bottom portion of casing 102. The flexible or longitudinal portion is a hollow tube or a wire including one or more electrical conductors. Ear tube 106 extends under the user's ear lobe. At its distal end portion, ear tube 106 connects to an ear bud 108, which may include a wax guard (not shown) and which fits within the ear canal of the ear, securing ear tube 106. Ear bud 108 (and its associated wax guard) secures ear tube 106. Thus, ear hook 104 and ear tube 106 (in conjunction with ear bud 108) secure hearing aid 100 from two sides of the ear (above and below).

In one embodiment, ear tube 106 is a sound tube sized to mate with an opening in connector 112 for delivering sound from a speaker within casing 102 to the ear bud 108 positioned within the user's ear canal. In this instance, ear tube 106 is a substantially hollow tube designed to transfer sound from one end to the other without noticeably attenuating the sound. In an alternative embodiment, ear tube 106 includes one or more insulated conductors or electrical wires configured to deliver modulated signals from a processor within casing 102 to a speaker within ear bud 108 for reproduction of sound to the user. In some embodiments where ear tube 106 includes electrical conductors, ear bud 108 can include additional electronic components, such as a speaker and/or a microphone, powered by a battery within casing 102.

Connectors 110 and 112 are substantially identical (for example, within manufacturing tolerances), allowing ear hook 104 and ear tube 106 to be interchanged, allowing the same receptacle to fit either connector. In such instances, ear hook 104 and ear tube 106 are interchangeable with respect to connectors 110 and 112. This interchangeability makes it possible for a user to configure the hearing aid 100 so that the ear tube 106 extends beneath the ear lobe in a first configuration and extends over the top of the ear in a second configuration. Further, because ear hook 104 and ear tube 106 are releasably connected to connectors 110 and 112, ear hook 104 and ear tube 106 can be replaced with other ear hooks or other tubes having different shapes, sizes, colors, textures, functionality, or any combination thereof.

For example, during normal operation, a user may be more comfortable with an over-the-ear configuration where the ear tube 106 extends over the user's ear. In this instance, the receptacle 107 of ear hook 104 can be connected to connector 112. In some instances, ear hook 104 includes a different shape, such as a substantially flat cap or cover, rather than a hook-shape. In this instance, ear hook 104 seals the electrical connector or opening in connector 112 to seal circuitry within casing 102 from the environment. Alternatively, ear hook 104 includes a flexible portion or adjustable hook portion that can be adjusted by the user to fit the shape of the bottom portion or lobe of the user's ear. During more strenuous activities, the user optionally reconfigures the hearing aid to utilize the ear hook 104 over the top of the ear and to extend the ear tube 106 beneath the ear (in an under-the-ear configuration as shown).

The connection assembly including the connector 110 and a corresponding receptacle 107 or 105 of the ear hook 104 or ear tube 106, respectively, can be implemented using any of a number of releasable connection structures, including a threaded (screw in type) mechanism, a clip connection, a snap-lock mechanism, a clasp connection, a clamp connection, a sliding connection, or another type of connection. In a particular example, the releasable attachment between the connectors 110 and 112 and the receptacles 105 and 107 includes a spring-loaded locking mechanism, a TRS (tip, ring, sleeve) connector, a modular connector system as used in Ethernet or telephone wires, or other types of connectors.

In an embodiment, each of the connectors 110 and 112 includes one or more electrical contacts configured to mate with wires within ear tube 106 for providing electrical signals to a speaker within ear bud 108 and/or for receiving electrical signals related to sounds from a microphone associated with ear bud 108. Further, ear hook 104 seals the electrical contacts from the environment. In some instances, ear hook 104 may include circuitry to connect to the one or more electrical contacts. Such circuitry may include a power circuit with a supplemental battery, a directional microphone, a processor, a global positioning system (GPS) circuit, a transceiver, or other circuitry. In some instances, such circuitry may provide a signal to circuitry within casing 102 to identify itself and its functionality, which information can be used by the circuitry within casing 102 to discontinue signals to the one or more electrical contacts and/or to make use of the functionality within ear hook 104.

In another embodiment, each of connectors 110 and 112 includes an opening for providing sounds to ear tube 106, which is a sound tube for delivering sound waves from a speaker within casing 102 to ear bud 108 without substantially altering the audio signals. In this instance, to accommodate the interchangeability of the ear hook 104 and the ear tube 106, casing 102 includes a first speaker adjacent to connector 110 and a second speaker adjacent to connector 112 for providing sounds to their respective openings. When connectors 110 and 112 include openings, ear hook 104 interfaces with the other connector that is not connected to ear tube 106 to terminate or attenuate the sounds. Alternatively, ear hook 104 may interface with an electrical lead or terminal at the particular connector to identify itself to circuitry within casing 102, which identification can be used by the circuitry to turn off power to the speaker adjacent to the connector 110 or 112 to which the ear hook 104 is connected.

In another alternative embodiment, hearing aid 100 includes a clip (not shown) that can be connected to ear tube 106 or to a portion of the casing 102, which clip is adjustable to attach to the user's ear lobe to further secure the casing 102 to the user's ear to prevent movement. In this alternative example, the casing 102 includes an adjustable portion that is flexible or adjustable to allow the user to adjust its angle and/or position relative to the ear lobe. In a particular example, this flexible portion includes a releasable ear lobe clip that can physically attach to the user's ear lobe in a manner similar to a clip-on earring. In another example, a retaining wire is coupled to the casing 102 or the ear tube 106 and is configured to attach to the cymba conchae of the user's ear to further secure hearing aid 100.

In the illustrated embodiment, both ear tube 106 and hook 104 are shown as removable modules, which may be interchanged with various sized tubes and hooks to fit the user's ear. Further, it should be understood that connectors 110 and 112 have substantially identical shapes and sizes, and receptacles 105 and 107 of ear tube 106 and ear hook 104, respectively, utilize the same physical connections to couple to connectors 110 and 112, interchangeably. Thus, the illustrated example of FIG. 1 depicts one of many possible arrangements of ear tube 106 and ear hook 104 relative to casing 102. In another configuration, as described below with respect to FIG. 2, hearing aid 100 can be reconfigured with an ear hook 104 sized to fit under a lower portion of the ear and with an ear tube 106 and ear bud 108 configured to fit over the ear.

Figure 2:
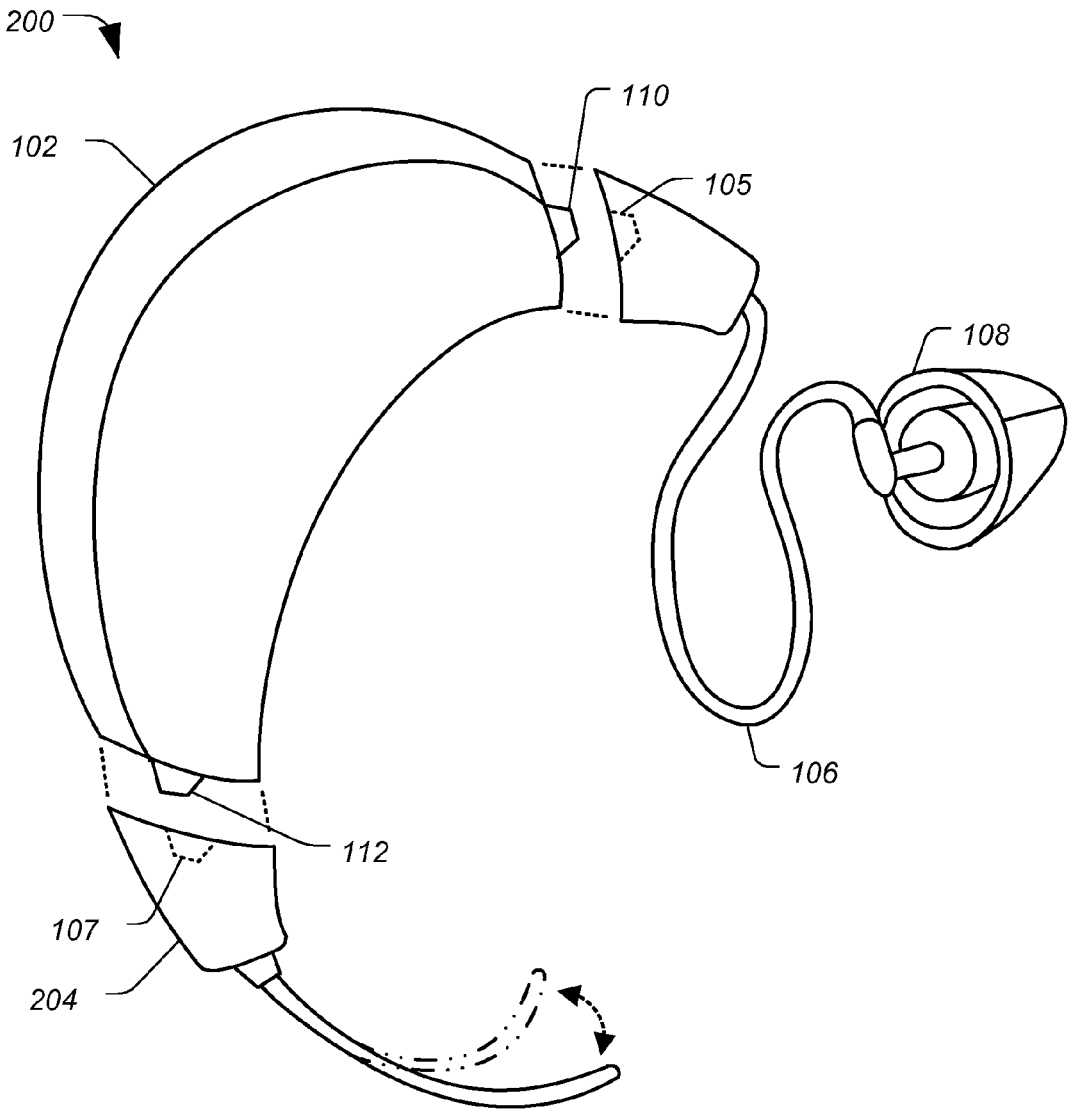
FIG. 2 is a perspective view of the hearing aid of FIG. 1 including an exploded view of the ear hook in an over-the-ear configuration.

FIG. 2 is a perspective view of a hearing aid 200 with casing 102 including ear hook 204 in an over-the-ear configuration. Ear hook 204 is shown in an exploded view relative to the second connector 112 for positioning ear hook 204 under the user's ear. Ear hook 204 can have a variety of different shapes and sizes, and a user can select a particular ear hook for comfort and fit. In the illustrated example, ear hook 204 is formed from a moldable material, allowing ear hook 204 to be flexed, bent or otherwise adjusted by the user to fit underneath the user's ear lobe.

In the illustrated example, ear tube 106 is depicted in an exploded view relative to connector 110. Ear tube 106 has a length and width designed to fit between the pinna at the top of the user's ear and the user's head where the outer ear attaches to the user's head. Ear tube 106 extends over and rests on the user's ear. Ear bud 108 connected to the other end of ear tube 106 fits into the user's ear canal, and ear tube 106 can be wrapped into the helix of the user's ear, such that the ear bud 108 and the wrapped portion of the ear tube 106 cooperate to secure the ear tube 106.

In this example, ear tube 106 rests on the top of the user's ear, counter-balancing the force of gravity. Ear bud 108 fits within the user's ear canal and cooperates with ear tube 106 to secure casing 102 behind the ear against the force of gravity. Ear hook 204 wraps around the bottom of the user's ear lobe, securing casing 102 against forces produced by sudden movements. In this manner, hearing aid 200 is secured behind, above, and below the ear.

It should be understood that ear hook 204 is one illustrative example out of many possible examples. Ear hook 204 can have other shapes and lengths to accommodate variations in the shape of the human ear. Further, another fastening device, in addition to ear hook 204 and ear tube 106, can also be used, such as a clip, clasp or retaining wire.

FIGS. 1 and 2 show two possible configurations for the ear hook and ear tube. It is possible to provide ear hooks with various lengths to accommodate variation in the size and shape of the human ear. Examples of some such ear hooks are described below with respect to FIG. 3.

Figure 3:
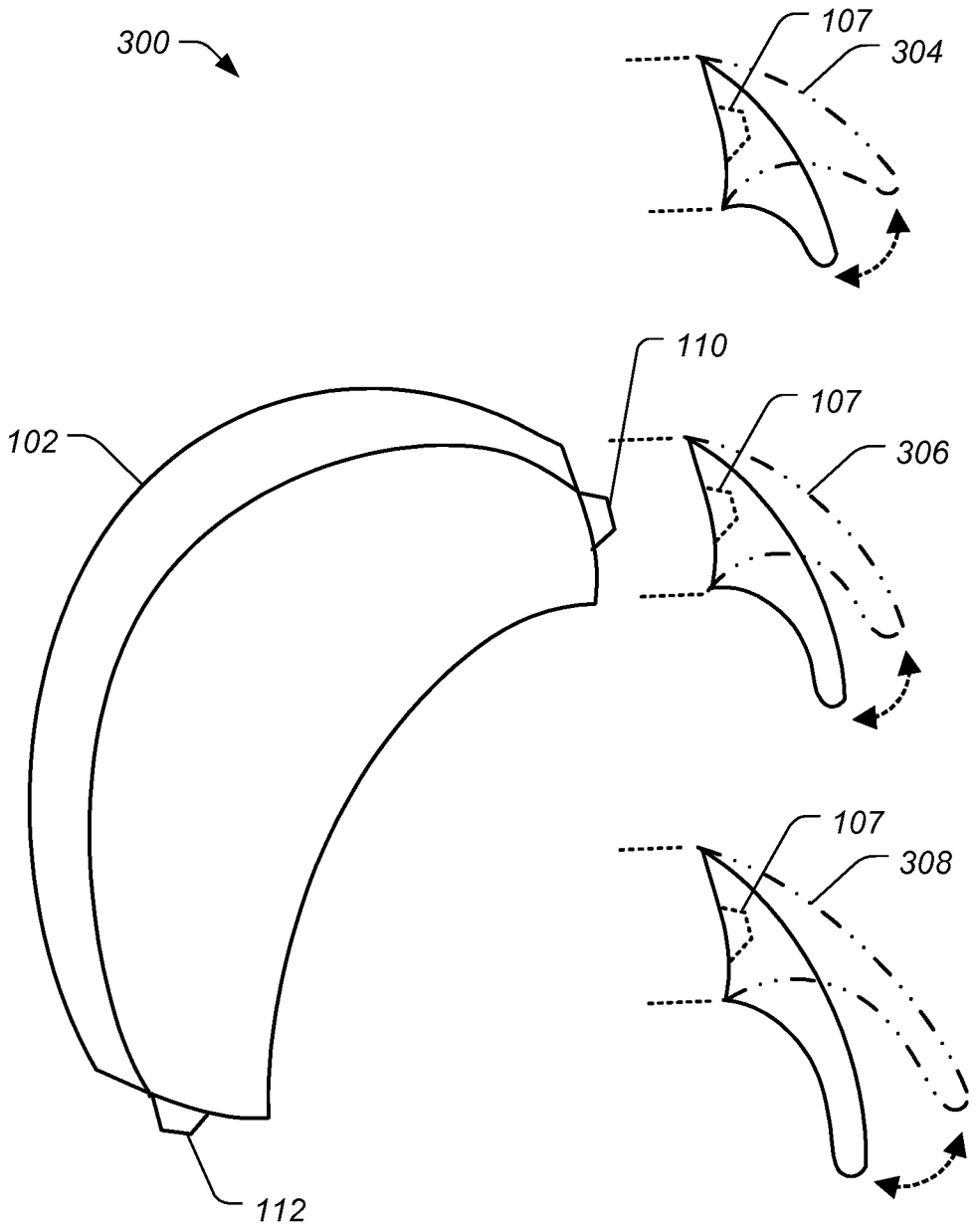
FIG. 3 is a perspective view of the hearing aid of FIG. 1 illustrating different sizes of ear hooks for use in an over-the-ear configuration.

FIG. 3 is a perspective view of a hearing aid system 300 including a casing 102 and various sized ear hooks (such as hooks 304, 306, and 308), which can be used in connection with the hearing aids of FIGS. 1 and 2 in a over-the-ear configuration. Casing 102 includes connectors 110 and 112, which are substantially the same. Each ear hook 304, 306, and 308 includes receptacle 107 for releasably connecting to either of the connectors 110 or 112, securing a selected one of ear hooks 304, 306, and 308 to casing 102. In the illustrated example, each of the ear hooks 304, 306, and 308 has a hook shape and is sized to fit over the user's ear and to rest on the pinna of the ear. Ear hooks 304, 306, and 308 are interchangeable, and can be connected to casing 102 at connector 110. Ear hooks 304, 306, and 308 are formed from a flexible material, and can have different lengths, widths, curvatures, and sizes. Multiple ear hooks, such as ear hooks 304, 306, and 308, are available to fit various different sizes of the human ear. In this embodiment, ear hooks 304, 306, and 308 are interchangeable by the user, allowing the user to selectively couple the one that provides the most comfortable fit to connector 110.

In addition to variations in sizes, ear hooks 304, 306, and 308 can have one or more different physical characteristics as well, such as different sizes, shapes, textures, dimensions, flexibilities, material properties, and/or colors. Further, ear hooks 304, 306, and 308 can have different functional characteristics, such as a capping function, a hooking function, and/or electrical circuitry functionality (such as signal processing, power supply, or other circuit functions). In a particular example, one or more of ear hooks 304, 306, and 308 include at least one of a light emitting diode, a power supply, a memory, a radio frequency tuner circuit for receiving radio frequency signals, and a radio frequency transceiver circuit for communicating radio frequency signals. In one example, the memory stores a music play list of stored music tracks for playback via a processor of hearing aid system 300. The variability in physical and functional characteristics allows each of the ear hooks 304, 306, and 308 to be customized, not only for comfort, fit, and feel, but also for aesthetic qualities and functional qualities.

Various sizes of under-the-ear hooks, such as hook 204 in FIG. 2, can be utilized in the same manner as ear hooks 304, 306, and 308 in an over-the-ear tube configuration. A user selects an appropriate one of ear hooks 304, 306, and 308 for comfort, fit, functionality, or another characteristic. In an example, the shape of the ear and the space between the ear lobe and the user's head differ from the top of the ear to the bottom of the ear, such that ear hooks for the over-the-ear configuration have different physical dimensions, different material characteristics, or other differences as compared to those used for under-the-ear configurations. As discussed above, the connectors 110 and 112 are the same, so the ear hooks 304, 306, and 308 can be connected to casing 102 via either connector 110 or connector 112. However, for many people, the shape of the ear lobe and the way the ear lobe attaches to the user's head provide a narrower space for the ear hook in the under-the-ear configuration than the space provided by the pinna for an over-the-ear configuration. Thus, in the under-the-ear configuration described below with respect to FIG. 4, connector 112 is utilized to secure the under-the-ear hooks, which have narrower shapes than ear hooks 304, 306, and 308.

Figure 4:
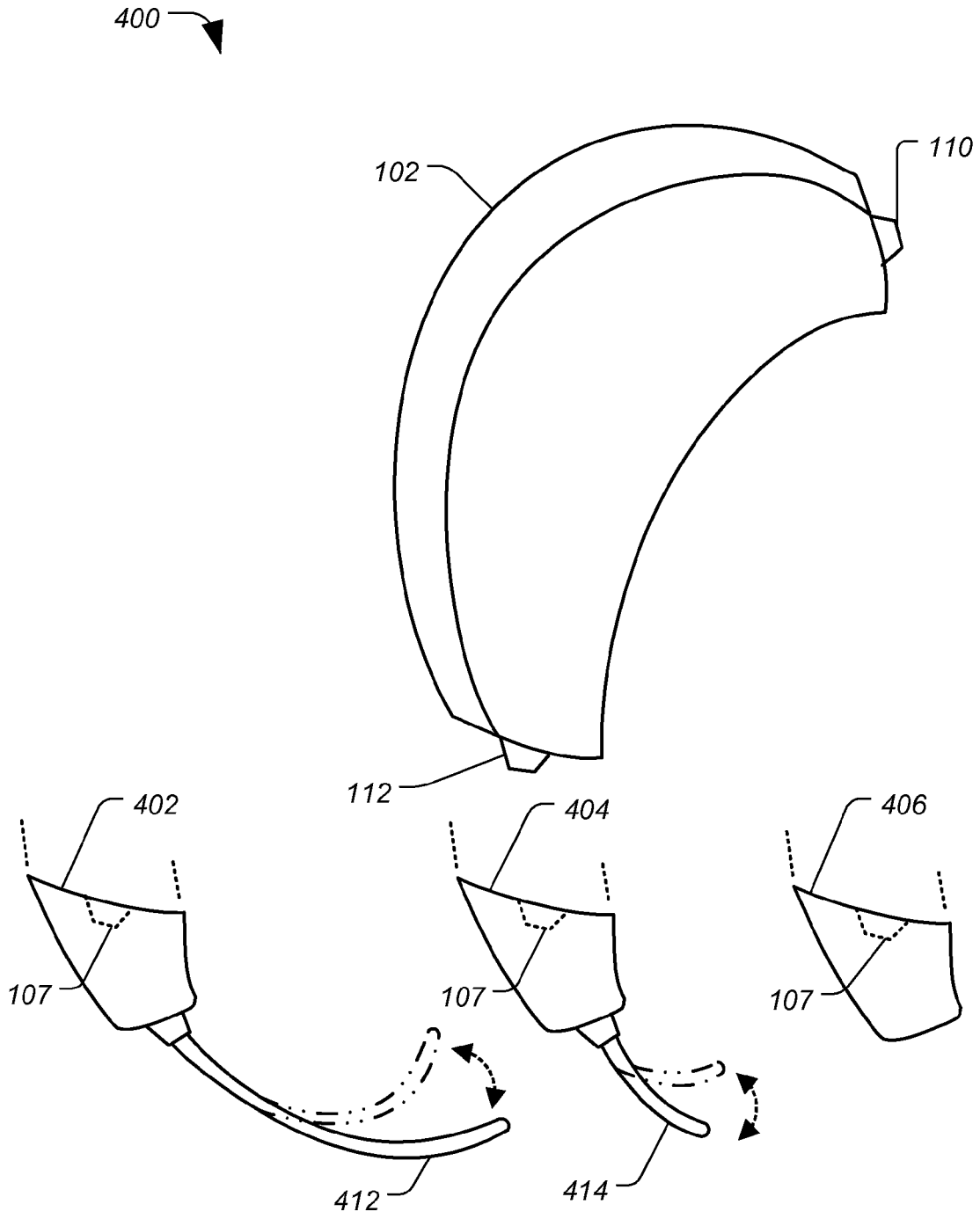
FIG. 4 is a perspective view of the hearing aid of FIG. 1 illustrating different attachments in an under-the-ear configuration.

FIG. 4 is a perspective view of a hearing aid 400 with various sized ear hooks 402, 404, and 406, which can be used in connection with the hearing aid, of FIG. 2 in an under-the-ear configuration. Hearing aid 400 includes casing 102 with connectors 110 and 112. Each of the ear hooks 402, 404, and 406 includes a receptacle 107 for connecting to connector 112. Thus, the user can select one of the ear hooks 402, 404, and 406 for connecting to connector 112. Ear hooks 402 and 404 connect to connector 112 and extend from a lower portion of casing 102 in a substantially hook shape. Ear hook 406 provides a cover or cap for connector 112, but does not extend to wrap under the ear. Ear hooks 402, 404, and 406 are interchangeable.

Ear hooks 402 and 404 are designed to fit between the ear lobe at the bottom of the user's ear and the user's head where the outer ear attaches to the user's head. Ear hooks 402 and 404 include hook portions 412 and 414 formed out of a moldable material, allowing the hook portions 412 and 414 to be adjusted by the user. Further, each hook portion, such as hook portions 412 and 414, can have a different length and size as compared to another hook portion. Multiple ear hooks are available to fit the various different sizes of the human ear. In the illustrated example, ear hook 406 is depicted as a cap, which can be connected to connector 112 to cover and protect the electrical contact or opening at connector 112, sealing the electrical contact or opening from the environment without hooking to the ear lobe. Ear hook 406 is designed for the user that does not wish to secure hearing aid 400 under their ear.

Ear hooks 402, 404, and 406 are interchangeable by the user, allowing the user to select the one that provides the most comfortable fit.

While the discussion of FIGS. 3 and 4 focused on the interchangeability of particular ear hooks 304, 306, 308, 402, 404, or 406 with connectors 110 or 112, respectively, it should be understood that other ear hooks having different sizes and shapes may also be provided. Further, ear tube 106 may be interchangeably connected to either of the connectors 110 or 112. An example of a hearing aid system depicting the interchangeability of ear tube 106 is described below with respect to FIG. 5.

Figure 5:
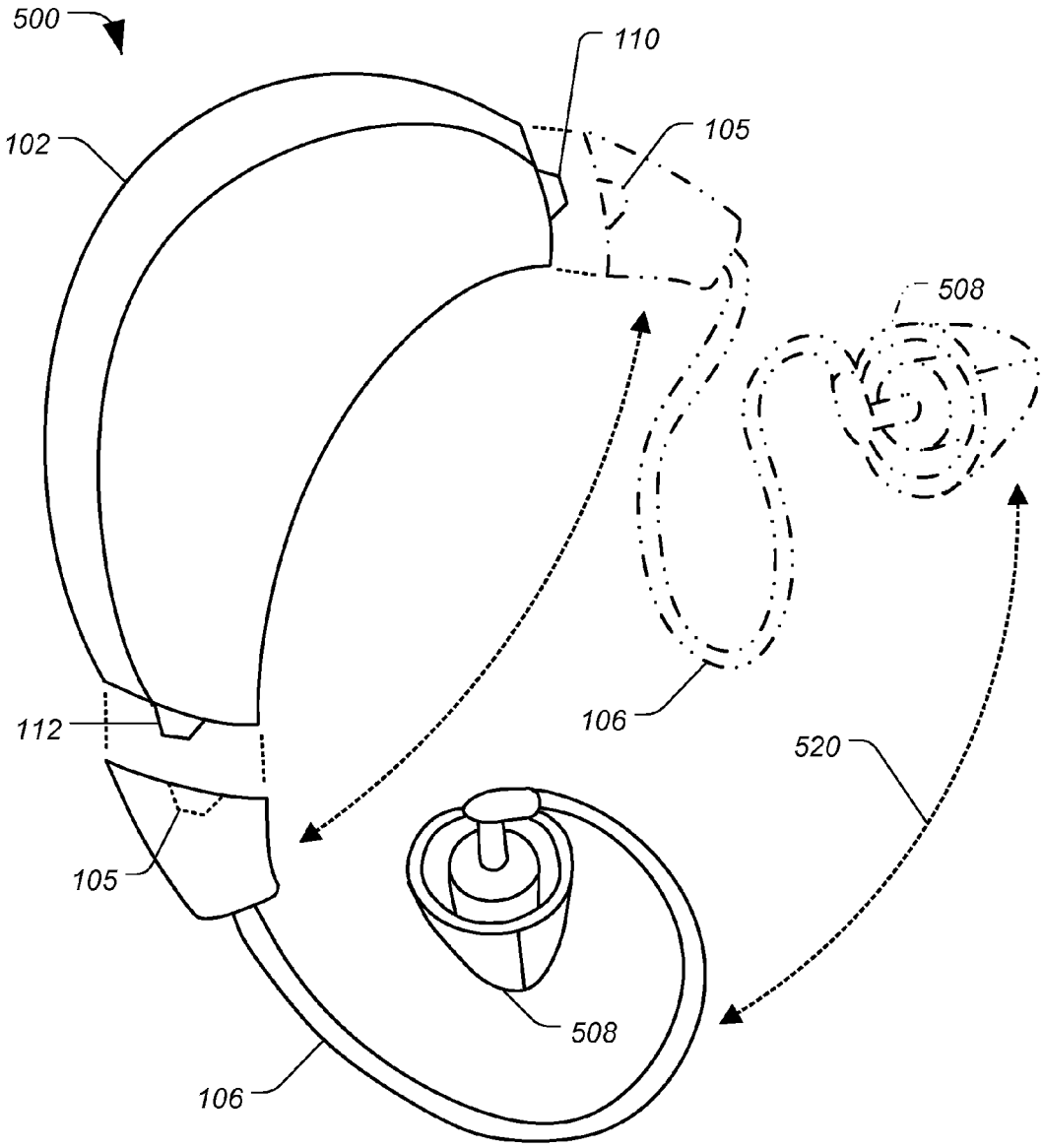
FIG. 5 is a perspective view of a hearing aid depicting the ear tube and wax guard in an under-the-ear configuration and the same ear tube and wax guard in phantom as an over-the-ear configuration.

FIG. 5 is a perspective view of a hearing aid 500, including casing 102, connectors 110 and 112, and ear tube 106 that can be interchangeably connected to either of connectors 110 or 112. Connectors 110 and 112 connect to receptacle 105 of ear tube 106 to releasably connect ear tube 106 to casing 102 in either of the two positions to provide fitting options to the user. In the illustrative embodiment, dashed arrow 520 represents the interchangeability of ear tube 106 between connectors 110 and 112. In an example, the user can disconnect ear tube 106 from connector 112 and can connect ear tube 106 to connector 110.

By providing two substantially identical connectors 110 and 112, the user may switch between under-the-ear and over-the-ear configurations as desired. Thus, when the user is performing activities including vigorous movements, the user may prefer the under-the-ear configuration where ear tube 106 is connected to connector 112. During other times, however, the user may prefer to use the over-the-ear configuration where the ear tube 106 is connected to connector 110. Connectors 110 and 112 and corresponding receptacle 105 of ear tube 106 makes such configurations selectable by the user.

Figure 6:
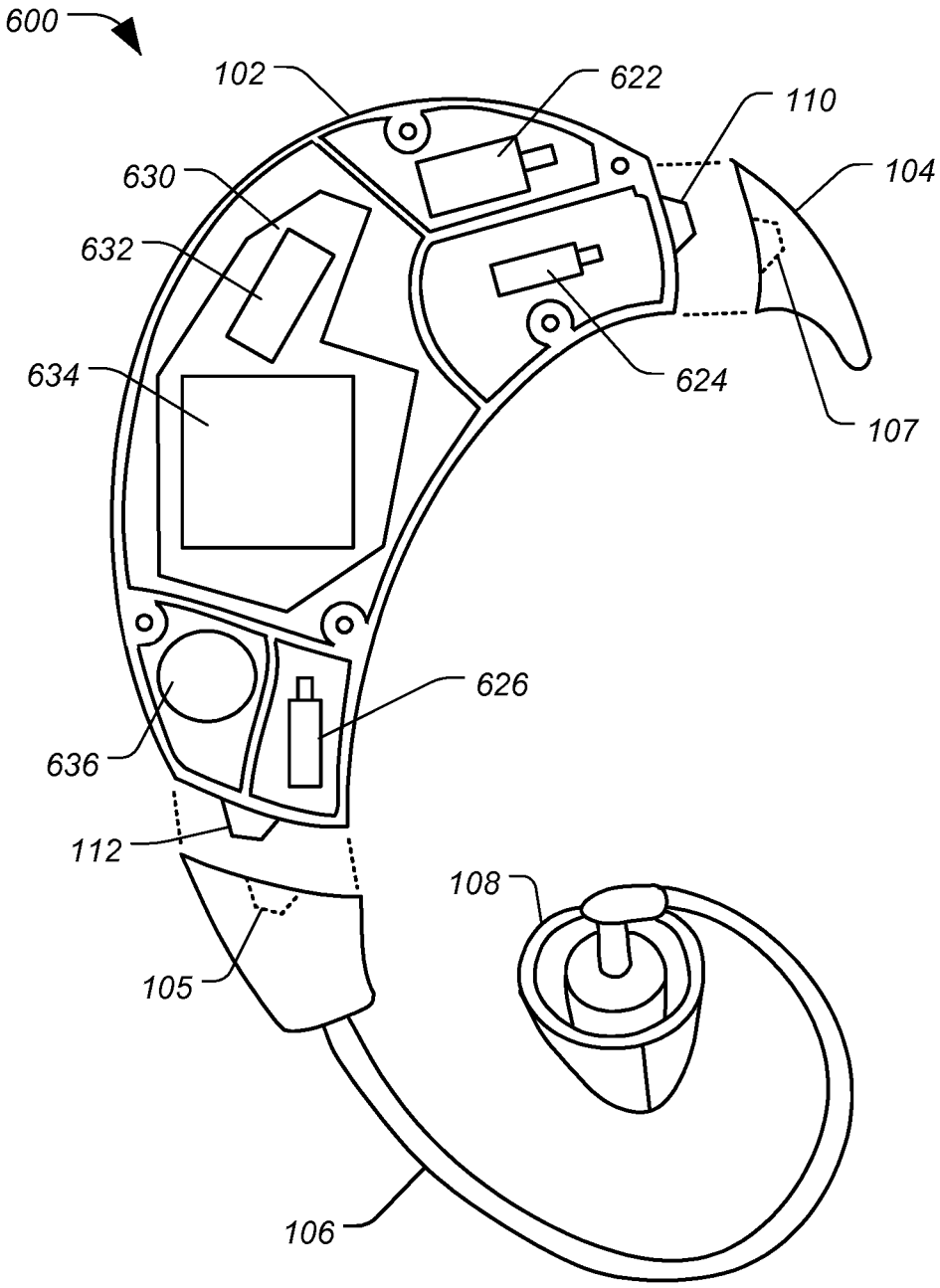
FIG. 6 is a cross-sectional view of an embodiment of the hearing aid of FIG. 1 including circuitry to process sound.

FIG. 6 is a cross-sectional view of a simplified embodiment of a hearing aid 600, (such as hearing aids 100, 200, 300, 400 and 500 depicted in FIGS. 1, 2, 3, 4, and 5, respectively) including circuitry to process sound. Hearing aid 600 includes a microphone 622 to convert sounds into electrical signals. Microphone 622 is communicatively connected to circuit board 630, which includes at least one processor 632 and memory device 634. Memory device 634 stores processor executable instructions, which are executable by processor 632 to shape the electrical signals into modulated electrical signals compensated for the hearing deficiency or deficit of the user. The instructions include one or more sound shaping algorithms or profiles that are customized to the user's hearing deficit.

Further, hearing aid 600 includes speakers 624 and 626 connected to processor 632 via a data link (not shown) and configured to communicate audio data through an electrical connection at connector 110 or connector 112, respectively. In particular, speakers 624 and 626 convert the modulated electrical signals into audio signals. Further, hearing aid 600 includes a battery 636 to supply power to the other components.

Ear hook 104 includes receptacle 107 adapted to mate with connector 110 to secure ear hook 104 to casing 102. Ear tube 106 includes a first end having a receptacle 105 adapted to mate with connector 112 and a second (distal) end connected to an ear bud 108. In this example, ear tube 106 is a hollow, sound-conducting tube for directing sound from speaker 624 or 626 to ear bud 108. Connectors 110 and 112 and receptacles 105 and 107 are substantially similar to each other such that ear hook 104 and tube 106 may be interchanged.

In one embodiment, microphone 622 converts sounds into electrical signals and provides the electrical signals to processor 632, which processes the electrical signals according to a hearing profile associated with the user (stored in memory device 634) to produce a modulated output signal customized to a user's hearing ability. Processor 632 provides the modulated output signal to at least one of the speakers 624 and 626, which reproduce the modulated output signal as an audio signal and provide it to the ear tube 106 through connector 112. Ear tube 106 carries the audio signal to ear bud 108. Ear hook 104 connects to connector 110 and operates as a cap or cover to seal the opening at connector 110 from exposure to the environment.

In an alternative embodiment, ear tube 106 is an electrically conducting wire rather than a sound conducting tube and speaker 624 is located in ear bud 108. In this instance, each of the connectors 110 and 112 includes an electrical contact for completing a communications link between processor 632 and the speaker within ear bud 108. In this instance, ear hook 104 acts as a cap to cover to seal the electrical contact of connector 110 from the environment. In operation, processor 632 will modulate the signal received from microphone 622 and provide the modulated signal to one or both of the connectors 110 and 112. As shown, ear tube 106 receives the modulated output signal from connector 112 and communicates it to a speaker (not shown) within ear bud 108, which speaker reproduces the modulated output signal as an audio signal for the user.

In another alternative embodiment, a selector (not shown) is interposed between processor 632 and connectors 110 and 112. In this instance, the selector detects the presence of a completed electrical signal created by coupling receptacle 105 of tube 106 to either connector 110 or 112 and directs the modulated signal to that connector or to the speaker 624 or 626 associated with that connector.

Figure 7:
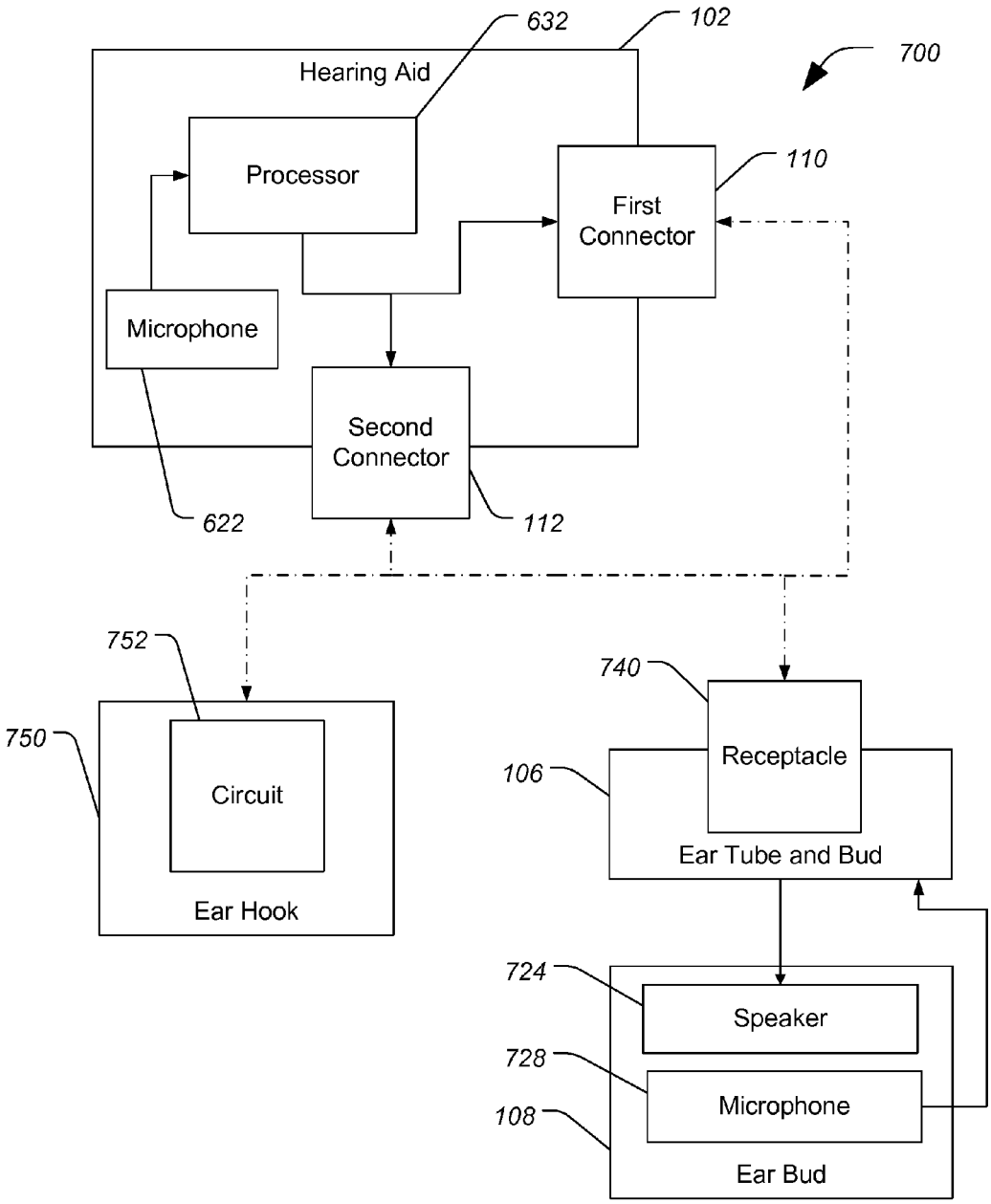
FIG. 7 is a block diagram of an embodiment of the hearing aid of FIG. 1 with multiple coupling locations including an ear tube.

FIG. 7 is a simplified block diagram view of a hearing aid system 700 including an embodiment of hearing aid 600 in FIG. 6, including multiple coupling locations and including an ear tube 106 and an ear hook that can be interchangeably connected to either of the coupling locations. Hearing aid 700 includes a casing 102 defining an enclosure to house a microphone 622 and a processor 632. Casing 102 also includes connector 110 located at an upper portion of casing 102 and connector 112 located at a lower portion of casing 102. Processor 632 is coupled to both connectors 110 and 112 and to microphone 622. Casing 102 also includes a memory 634 as described with respect to FIG. 6. For the ease of discussion, memory 634 is not further discussed with respect to the example in FIG. 7.

Ear tube 106 includes receptacle 740, which is configured to be secured to either connector 110 or connector 112 to receive the modulated sound signal. Receptacle 740 provides the modulated signal to ear bud 108 for reproduction for the user by speaker 724. In some instances, ear bud 108 includes a microphone 728, which may communicate sound-related signals to processor 632 of hearing aid 700 via ear tube 106 and receptacle 740. Ear hook 750 connects to the other one of the connectors 110 or 112. In some embodiments, ear hook 750 includes a circuit 752.

In operation, microphone 622 or 728 converts sounds into electrical signals and provides the electrical signals to processor 632. Processor 632 modulates the electrical signal to produce modulated signals, and provides the modulated signals to speaker 724 through the electrical connection at either of the connectors 110 or 112.

In an alternative example, speaker 724 is positioned within casing 102 and ear tube 106 is a sound tube, such that processor 632 provides the modulated signal to speaker 724 within casing 102 for reproduction as a modulated sound, and the sound tube relays the modulated sound to the user through ear tube 106 and ear bud 108. In this alternative example, microphone 728 can be omitted.

In the above-examples, the interchangeability of the ear hooks makes it possible for the user to adjust the fit of the hearing aid by replacing the ear hook without replacing the casing 102 or the entire hearing aid system. Further, the interchangeability of the ear hooks with the ear tubes makes it possible for the user to adjust the fit of the hearing aid to make the hearing aid more resistant to shifting or moving due to movement of the user. Additionally, interchangeability of the hear hooks makes it possible for the user to refine or otherwise adjust the function of the hearing aid, for example, by interchanging a cap-shaped ear hook with another cap-shaped ear hook that includes a microphone. The modular components may include different electrical components or no electrical components, depending on the particular implementation. Such electrical components can include a microphone, a global positioning system (GPS) circuit, a light-emitting diode, a camera, a memory, an input/output port for receiving an external connector, or one or more other electronic components. The user can interchange such components to add or remove functionality as desired. In such instances, the processor 632 within casing 102 executes instructions stored in storage device 634 to make use of such electrical components.

Further, the interchangeability of both the ear hook 104 and the ear tube 106 makes it possible for the same hearing aid casing 102 to be used in either an over-the-ear configuration or an under-the-ear configuration. Further, the ear hook 104 and the ear tube 106 can be selectively interchanged by the user to reconfigure the hearing aid configuration for a particular purpose and/or to simply vary the fit of the device. Thus, embodiments of a hearing aid are described above with respect to FIGS. 1-7, which are configurable by the user to adjust the fit of the hearing aid, without requiring the user to revisit the doctor.

Circuit 752 within ear hook 750 provides additional functionality and usability. Accordingly, ear hook 750 represents more than a fitting accessory, providing additional functionality to hearing aid 700. In one embodiment, circuit 752 includes a battery for providing supplemental power to hearing aid 700 when ear hook 750 is connected to casing 102. In another embodiment, circuit 750 includes an input/output port, such as a mini port, a TSR (tip sleeve, ring receptacle), or a USB (universal serial bus) receptacle, which can be used to interface with a corresponding connector for receiving and optionally sending data and instructions. In one instance, the input/output port couples to a corresponding connector to receive data and/or instructions for updating hearing aid settings, such as signal processing instructions and firmware updates.

In an embodiment, circuit 752 includes a memory additional to memory 634 in FIG. 6, which stores updates to the signal processing instructions, customized signal processing instructions, song play lists, or other data. In another embodiment, circuit 752 includes a processor additional to digital signal processor 632 in FIG. 6, a microphone additional to microphone 622 in FIG. 6, an accelerometer, a Bluetooth® transceiver, other circuitry, or any combination thereof. In a particular instance, circuit 752 includes audio signal processing instructions and circuitry to supplement circuitry within the casing or body of the hearing aid. In another embodiment, circuit 752 includes a battery coupled to an LED (light emitting diode) to provide a more high tech look to hearing aid 700 or to provide hands-free illumination in close work environments, such as automobile service environments, and the like. In still another embodiment, circuit 752 includes a battery and a power supply control circuit configured to provide a supplemental (or extended) power supply to the hearing aid 700.

Ear hook 750 can also provide additional aesthetic qualities to hearing aid 700. For example, ear hook 750 can be changed to provide aesthetic personalization, allowing the user to change various aesthetic parameters, such as color, texture, shape, and other visible features. In some instances, ear hook 750 can be interchanged with other ear hooks that have different physical characterizations.

In conjunction with the hearing aids and configurations described above with respect to FIGS. 1-7, a hearing aid is disclosed that includes at least two connectors that are substantially identical and that are configured to interchangeably connect to an ear hook and an ear tube to allow a user to configure the hearing aid. In some instances, the size and shape of the ear hooks vary, and the ear hook can include a flexible and/or moldable portion to allow a user to adjust the ear hook for a better fit. Further, the ear tube can be connected to an ear bud at an opposite end, which ear bud is configured to deliver sounds to the user's ear canal. Thus, the same hearing aid can be configured to be worn by a user in an over-the-ear configuration (where the ear tube rests on top of the user's ear) or in an under-the-ear configuration (where the ear tube extends under the ear lobe of the user). Such interchangeability provides user adjustability to enhance the fit and security of the hearing aid during various physical activities.

Although the present invention has been described with reference to preferred embodiments, and although numerous characteristics and advantages of various embodiments of the invention have been set forth in the above description together with details of the structure and function of various embodiments of the invention, it should be appreciated that this disclosure is illustrative and that changes may be made in detail, especially in matters of structure and arrangement of parts, without departing from the scope of the present invention. For example, a speaker may be included within casing 102 or within ear bud 108. Further, the shapes and size dimensions of ear hooks 104 may be varied to accommodate the sizes and shapes of the ears of different people. Further, the ear hooks 104 may include additional circuitry or electronic components, which may be selected by the user to perform a variety of functions independent of the physical attachment of the hearing aid. Thus, the invention encompasses the above-described embodiments, as well as changes in the structure, the arrangement of parts, and other aspects within the principles of the present invention, at least to the full extent indicated by the broad general meaning of the terms in which the appended claims are expressed.

What is claimed is:

1. A hearing aid comprising:

a casing adapted to fit behind an ear of a user, the casing including a first connector located near the top of the casing and a second connector located near the bottom of the casing, the top of the casing being the portion of the casing near the upper portion of the ear when the hearing aid is worn;

an ear hook configured to releasably couple to either the first or second connector and an ear tube configured to couple to either the first or second connector, such that the hearing aid has two configurations when worn: (i) having the ear hook coming over the ear and the ear tube under the ear when worn and (ii) having the ear tube coming over the ear and the ear hook under the ear when worn;

wherein the ear hook and the ear tube apply substantially opposing pressures to the upper portion of the ear and to the ear lobe to secure the casing behind the ear in an under-the-ear configuration.

2. The hearing aid of claim 1, wherein the ear tube comprises an electrical conductor; and an ear bud, the ear bud including a speaker coupled to the electrical conductor.

3. The hearing aid of claim 2, wherein the ear tube further comprises a second electrical conductor; and wherein the ear bud further includes a microphone coupled to the second electrical conductor and configured to convert sounds into electrical signals and to communicate the electrical signals to circuitry within the casing.

4. The hearing aid of claim 1, wherein the ear hook is adjustable.

5. The hearing aid of claim 1, wherein the ear tube has a first set of characteristics and is interchangeable with a second ear tube with a second set of characteristics.

6. The hearing aid of claim 5, wherein the ear hook includes a battery to provide power to circuitry within the casing.

7. The hearing aid of claim 5, wherein the ear hook has a first set of physical characteristics and is interchangeable with a second ear hook with a second set of physical characteristics.

8. The hearing aid of claim 7, wherein the ear hook includes a circuit configured to communicate with circuitry within the casing.

9. A hearing aid comprising:

a casing including a first connector on an upper portion of the casing and a second connector on a lower portion of the casing, the first and second connectors for releasably coupling to both an ear tube and an ear hook; and wherein the first and second connectors are substantially identical such that the ear hook and the ear tube are interchangeable between the upper portion of the casing and the lower portion of the casing.

10. The hearing aid of claim 9, wherein the ear hook is coupled to the first connector on the upper portion of the casing and ear tube is coupled to the second connector on the lower portion of the casing in an under-the-ear configuration.

11. The hearing aid of claim 9, wherein the ear hook is coupled to the second connector on the lower portion of the casing and the ear tube is coupled to the first connector on the upper portion of the casing in an over-the-ear configuration.

12. The hearing aid of claim 9, wherein the ear hook has a first set of physical characteristics and is interchangeable with a second ear hook with a second set of physical characteristics.

13. The hearing aid of claim 12, wherein the first set of physical characteristics includes a size characteristic, a shape characteristic, a color characteristic, and a texture characteristic; and wherein the second set of physical characteristics includes a second size characteristic, a second shape characteristic, a second color characteristic, and second texture characteristic; and wherein at least one of the first set of physical characteristics differs from a corresponding one of the second set of physical characteristics.

14. The hearing aid of claim 9, wherein the ear hook includes a microphone.

15. The hearing aid of claim 9, wherein the ear hook includes a processor.

16. The hearing aid of claim 9, wherein the ear hook includes a port adapted to receive an external connector.

17. The hearing aid of claim 9, wherein the ear hook includes at least one of a light emitting diode, a power supply, a memory, a radio frequency tuner circuit, and a radio frequency transceiver circuit.

18. The hearing aid of claim 9, wherein the first and second connectors include electrical contacts.

19. A hearing aid comprising:

a processor configured to modulate sounds into electrical signals according to a hearing deficit of a user;

a housing to enclose the processor and including a first connector coupled to the processor and a second connector coupled to the processor, the first and second connectors being substantially identical, the first connector being located near the top of the housing and the second connector being located near the bottom of the housing;

a first ear hook including a receptacle sized to mate with the first connector and the second connector, the first ear hook configurable by the user to couple to one of the first connector and the second connector;

an ear tube including a first end having a receptacle sized to mate with the first connector and the second connector, the ear tube including a longitudinal portion and including a second end coupled to an ear bud sized to fit within an ear canal of the user, the ear tube configurable by the user to couple to another of the first connector and the second connector; and wherein the hearing aid has two configurations when worn by a user: (i) having the ear hook coming over an ear of the user and the ear tube under the ear of the user when worn and (ii) having the ear tube coming over the ear of the user and the ear hook under the ear of the user when worn by the user.

20. The hearing aid of claim 19, further comprising:

a second ear hook adapted to couple to the first connector and the second connector, the second ear hook interchangeable with the first ear hook to couple to the housing.

21. The hearing aid of claim 20, wherein:

the first ear hook has a first size, a first shape, a first flexibility, a first curvature, and a first functionality; and the second ear hook has a second size, a second shape, a second flexibility, a second curvature, and a second functionality; and at least one of the second size, the second shape, the second flexibility, the second curvature, and the second functionality differs from a corresponding one of the first size, the first shape, the first flexibility, the first curvature, and the first functionality.

* * * * *